US010457090B2

(12) United States Patent
Tepe et al.

(10) Patent No.: US 10,457,090 B2
(45) Date of Patent: Oct. 29, 2019

(54) EXPANDABLE PACKAGE FILLER OR ORNAMENT

(71) Applicants: Ted Tepe, Sterling, MA (US); Liang Rong Lin, Surrey (CA)

(72) Inventors: Ted Tepe, Sterling, MA (US); Liang Rong Lin, Surrey (CA)

( * ) Notice: Subject to any disclaimer, the term of this patent is extended or adjusted under 35 U.S.C. 154(b) by 69 days.

(21) Appl. No.: 15/528,650

(22) PCT Filed: Jan. 27, 2016

(86) PCT No.: PCT/US2016/015028

§ 371 (c)(1),
(2) Date: May 22, 2017

(87) PCT Pub. No.: WO2016/126473

PCT Pub. Date: Aug. 11, 2016

(65) Prior Publication Data

US 2017/0267018 A1 Sep. 21, 2017

Related U.S. Application Data

(60) Provisional application No. 62/111,229, filed on Feb. 3, 2015, provisional application No. 62/183,236, filed on Jun. 23, 2015.

(51) Int. Cl.
*B44C 3/08* (2006.01)
*B44C 3/02* (2006.01)
(Continued)

(52) U.S. Cl.
CPC ..... *B44C 3/082* (2013.01); *B26D 3/11* (2013.01); *B26F 1/44* (2013.01); *B31D 5/0065* (2013.01);
(Continued)

(58) Field of Classification Search
CPC .. B65D 81/05; B65D 63/10; B65D 2581/053; D04D 7/06; D04D 7/08; D04D 7/10
(Continued)

(56) References Cited

U.S. PATENT DOCUMENTS 603,619 A 5/1898 Burger
1,940,596 A 12/1933 Koppelman ..... 229/87
(Continued)

FOREIGN PATENT DOCUMENTS

EP 0 717 714 3/2000
GB 820 907 A 9/1959
(Continued)

OTHER PUBLICATIONS

Dioguardo, G.; "Print It: Simple Paper Ornaments", 2009, p. 1-2; Accessed on Mar. 6, 2018 athttps://web.archive.org/web/20091030172901/https://www.parents.com/holiday/christmas/crafts/print-it-simple-paper-ornaments/.*
(Continued)

*Primary Examiner* — Humera N Sheikh
*Assistant Examiner* — Julia L Rummel
(74) *Attorney, Agent, or Firm* — Sunstein Kann Murphy & Timbers LLP

(57) ABSTRACT

An expandable package filler or ornament includes a stack of sheets, such as tissue paper, foil, etc. The stack is bound together, such as by a fastener. A generally spiral cut extends from a peripheral edge of the stack toward the center of the each sheet. The cut forms each sheet into a generally spiral strip ending in a peninsula portion. Grasping the peninsula portion, lifting and shaking the stack causes the strips to fall and entangle with each other. The resulting structure is decorative and may be used to stuff a gift box, bag or basket.

22 Claims, 13 Drawing Sheets

(51) Int. Cl.

| | |
|---|---|
| ***B26D 3/11*** | (2006.01) |
| ***B26F 1/44*** | (2006.01) |
| ***B42B 5/00*** | (2006.01) |
| ***B31D 5/00*** | (2017.01) |
| ***B65D 81/05*** | (2006.01) |
| ***D04D 7/06*** | (2006.01) |
| ***D04D 7/08*** | (2006.01) |

(52) U.S. Cl.
CPC ..... *B42B 5/00* (2013.01); *B44C 3/02* (2013.01); *B65D 81/05* (2013.01); *D04D 7/06* (2013.01); *D04D 7/08* (2013.01); *B26F 2210/02* (2013.01)

(58) Field of Classification Search
USPC ..... 428/7
See application file for complete search history.

(56) References Cited

U.S. PATENT DOCUMENTS

| | | | | |
|---|---|---|---|---|
| 2,809,455 | A | 10/1957 | De Haven | 41/10 |
| 2,859,489 | A | 11/1958 | Morrison | 20/4 |
| 3,074,543 | A | 1/1963 | Stanley | 206/46 |
| 3,650,877 | A | 3/1972 | Johnson | 161/47 |
| 4,201,806 | A | 5/1980 | Cole | 428/4 |
| 4,241,832 | A | 12/1980 | Bliss | 206/523 |
| D319,419 | S | 8/1991 | Cheng | D11/184 |
| 5,134,013 | A | 7/1992 | Parker | 428/182 |
| D330,876 | S | 11/1992 | Huber | D11/141 |
| 5,167,086 | A | 12/1992 | Fast | 40/299 |
| 5,265,727 | A | 11/1993 | Anderson | 206/457 |
| 5,419,731 | A | 5/1995 | Watkins | 446/475 |
| 5,465,530 | A | 11/1995 | Santoiemmo | 47/84 |
| 5,585,150 | A | 12/1996 | Sheehan | 428/15 |
| 5,714,210 | A | 2/1998 | Watkins | 428/7 |
| 5,882,767 | A | 3/1999 | Simmons, Jr. | 428/126 |
| D410,871 | S | 6/1999 | Hamowy | D12/114 |
| D414,722 | S | 10/1999 | Hamowy | D12/114 |
| 6,027,773 | A | 2/2000 | Sterr et al. | 428/7 |
| 6,237,819 | B1 | 5/2001 | Ramirez | 223/46 |
| D444,416 | S | 7/2001 | Ramirez | D11/184 |
| 6,332,823 | B1 | 12/2001 | Rouse, Jr. | 446/220 |
| 6,379,021 | B1 * | 4/2002 | Shieh | A47G 33/06 362/123 |
| 6,561,356 | B2 | 5/2003 | Weder | 206/584 |
| 7,718,241 | B2 | 5/2010 | Wittmeyer, Jr. | 428/40.1 |
| D632,343 | S | 2/2011 | Kindsgrab | D21/400 |
| 7,935,407 | B2 | 5/2011 | Chen | 428/136 |
| 8,152,588 | B2 | 4/2012 | Hua | 446/220 |
| 2001/0049922 | A1 | 12/2001 | Weder | 53/472 |
| 2001/0051279 | A1 * | 12/2001 | Docherty | A47G 33/06 428/461 |
| 2003/0009988 | A1 | 1/2003 | Deis | 53/449 |
| 2007/0197125 | A1 | 8/2007 | Marietta | 446/176 |
| 2011/0186474 | A1 | 8/2011 | Weder | 206/594 |
| 2015/0047799 | A1 | 2/2015 | Medoff | 162/141 |

FOREIGN PATENT DOCUMENTS

| | | |
|---|---|---|
| GB | 827 400 A | 2/1960 |
| GB | 2 415 425 | 12/2005 |
| JP | 2003/231400 | 8/2003 |
| WO | WO 2016/126473 | 8/2016 |

OTHER PUBLICATIONS

Hooper, M.; "Whoot Owl Wreath", 2014, p. 1-9; Accessed at http://thinkcrafts.com/blog/2014/10/08/whoot-owl-wreath/.*

Ali Express, Rayon Raffia Gift Boxes Filler in Multi-color Raffia Shred Paper Crinkle Cut, https://www.aliexpress.com/item/Free-shipping-Rayon-Raffia-Gift-Boxes-Filler-In-Multi-color-Raffia-Shred-Paper-Crinkle-Cut-50packs/1923985036.html, 1 page, retrieved online Nov. 19, 2015.

Amazon, Creative Converting Glitz Red Hanging Decor 3-Tier Foil Streamer Chandelier, www.amazon.com/Creative-Converting-Hanging-Streamer-Chandelier/dp/B009X8O970, 1 page, retrieved online Nov. 19, 2015.

FlipKart.com, Themez Only Dangling Swirls—Barbie Streamer, 1 page, retrieved online Nov. 19, 2015.

Frank, DIY Crepe Paper Tassel Garland, 17 pages, Feb. 12, 2014.

Korean Intellectual Property Office, International Search Report, PCT/US2016/015028, together with the Written Opinion of the International Searching Authority, 12 pages, dated May 9, 2016.

LemonDropPie.com, Halloween-y Crafts, Spin Cycle and Ladies Only Blog Share, http://www.lemondroppie.com/2013/10/easy-halloween-crafts/, 12 pages, Oct. 25, 2013.

Oh Happy Day, Spiral Mobiles DIY, http://ohhappyday.com/2015/05/spiral-mobiles-diy/, 2 pages, May 20, 2015.

PartyCity.com, Celebrate 50$^{th}$ Birthday Swirl Decorations, www.partycity.com, 1 page, retrieved online Nov. 12, 2015.

Renners, How to make paper flowers step by step, 5 pages, retrieved online Feb. 2, 2015.

SistersSavingCents.com, DIY: Tissue Paper Roses, www.sisterssavingcents.com/crafts/diy-tissue-paper-roses, 7 pages, retrieved online Feb. 2, 2015.

The Snap Source, Inc., Intro to Snap Fasteners, https://web.archive.org/web/20140613145713/http://www.snapsource.com/faqs/introtosnaps.php, 2 pages, Jun. 13, 2014.

Thrify Decorating, Paper Rosette Frame, 6 pages, Feb. 3, 2011.

Tinkerlab, Spiral Watercolor Streamer, http://tinkerlab.com/spiral-watercolor-streamer/, 1 page, retrieved online Nov. 19, 2015.

Wikipedia, "Interference fit," https://en.wikipedia.org/w/index.php?title=Interference_fit&oldid=606777221, 4 pages, May 2, 2014.

Wikipedia, "Resilience (materials science)," https://en.wikipedia.org/w/index.php?title=Resilience_(materi als_science)&oldid=607415156, 2 pages, May 7, 2014.

Wikipedia, "Snap fastener," https://web.archive.org/web/20140512042155/http://en.wikipedia.org/wiki/Snap_fastener, 2 pages, Feb. 24, 2014.

European Patent Office, Extended European Search Report, Application No. 16746986.5, dated Oct. 10, 2017, 8 pages.

* cited by examiner

EXPANDABLE PACKAGE FILLER OR ORNAMENT

CROSS REFERENCE TO RELATED APPLICATIONS

This application claims priority to, and benefit of, U.S. Provisional Patent Application No. 62/111,229, filed Feb. 3, 2015, titled "Expandable Package Filler and Ornament," and U.S. Provisional Patent Application No. 62/183,236, filed Jun. 23, 2015, titled "Expandable Package Filler and Ornament," the entire contents of each of which are hereby incorporated by reference herein, for all purposes.

TECHNICAL FIELD

The present invention relates to decorative paper products and, more particularly, to decorative paper products for package filler and ornaments.

BACKGROUND ART

Wrapping tissue paper is commonly used to package and cushion fragile goods within containers, including gift boxes and bags. Typically, entire sheets are lightly crumpled (crushed, so as to becomes creased and wrinkled) and stuffed around gifts, such as bottles of wine, in gift bags. Sometimes shredded tissue paper is used instead of, or in addition to, entire sheets as the stuffing material. As used herein, "shred" means a long narrow strip cut or torn from a larger whole sheet of material. Colorful paper sheets and/or shred make festive packaging materials, filling out a gift box or bag. In addition, crafters often make decorative items, such as flowers, from tissue paper or shred.

Although tissue paper typically has low bending stiffness, crumpled tissue paper, particularly several sheets or many pieces of shredded tissue paper randomly crumpled, provide very satisfactory cushioning at low cost. In addition, the packaging material is light weight, generally non-toxic and it can be easily recycled.

However, many people find it difficult to crumple sheets of tissue paper so as to meet twin goals of decoratively filling a gift box or bag and providing adequate cushioning. Shredded tissue paper may be easier to use in this regard. Shred, typically paper shred, is commonly bulk packaged and sold as filler. However, packages of pre-shredded tissue paper are voluminous, inasmuch as much of the packages' volumes are occupied by air, creating storage problems. For example, retail store shelf and hanging display space is limited, making it difficult to store and display sufficient quantities and varieties (colors, etc.) of shredded tissue paper.

SUMMARY OF EMBODIMENTS

Embodiments of the present invention include a stack of tissue paper or other suitable material sheets. The sheets are stacked one directly on top of the next, flat and parallel, and therefore occupy relatively little volume, inasmuch as very little volume of air remains between adjacent sheets. Each stack may be die cut along a spiral or other path to define a stack of parallel, vertically registered long, relatively narrow strips of the material. A stack may contain many sheets, yet occupy little volume in shipment, storage or on display in a store. The stack thickness is little more than the sum of the thicknesses of the individual sheets. Thus, the stack may be stored in an envelope. A user may grasp an end of the stack of spiral-shaped strips and lift, and optionally shake, it. The strips entangle with each other, forming a greatly expanded, over the volume of the unexpanded stack, filler. These embodiments solve the problem of insufficient space to store conventional packaged, pre-shredded material.

An embodiment of the present invention provides an expandable filler. The expandable filler includes a stack of parallel sheets. Each sheet includes a flexible material. Each sheet has a respective thickness. Each sheet defines at least one cut through the thickness of the sheet. The cut extends from a peripheral edge of the sheet to a location radially inward of the peripheral edge of the sheet. The at least one cut defines a peninsula portion of the sheet. The peninsula portion of the sheet is proximate the location radially inward of the peripheral edge of the sheet. The cuts through the respective sheets of the stack register along an axis. The axis is substantially perpendicular to planes of the sheets. All peninsula portions of the respective sheets register along the axis substantially perpendicular to planes of the sheets.

The expandable filler may also include a fastener binding together the stack of sheets. The fastener may bind the sheets along the axis substantially perpendicular to planes of the sheets.

The fastener may be disposed proximate the peninsula portions of the respective sheets. The fastener may be disposed proximate the peripheral edge of the respective sheets.

The fastener may include a staple. The fastener may include a grommet. The fastener may include an adhesive. The fastener may include a punched hole extending through the stack of parallel sheets, thereby fusing adjacent sheets to each other.

The cut may follow a generally circular spiral path. The cut may follow a generally square spiral path. The cut may follow a generally irregular spiral path.

Each peninsula portion may define a generally circular hole through the stack of sheets. The hole may register along the axis substantially perpendicular to planes of the sheets. That is, the holes through the respective sheets may all register along the axis substantially perpendicular to planes of the sheets. The expandable filler may also include a plurality of fasteners disposed outside a periphery of the generally circular hole. Each fastener may bind together the stack of sheets vertically.

Each sheet of the stack of sheets may include a sheet of paper. Each sheet of the stack of sheets may include a sheet of crêpe paper. Each sheet of the stack of sheets may include a sheet of plastic. At least one sheet of the stack of sheets may include a sheet of foil, and each sheet of a remainder of the stack of sheets may include a sheet of paper. At least one sheet of the stack of sheets may include a sheet of plastic, and each sheet of a remainder of the stack of sheets may include a sheet of paper.

Each sheet of the stack of sheets may include a sheet having a thickness less than about 2 mil. Each sheet of the stack of sheets may include a sheet having a thickness less than about 1 mil.

An expandable decoration may include the expandable filler and a fastener binding together the stack of sheets. The fastener may bind the sheets along the axis substantially perpendicular to planes of the sheets. The expandable decoration may also include a panel. The panel may have an image affixed on at least a first surface thereof. The panel may be attached to the stack of sheets proximate the fastener.

The expandable decoration may also include a mounting attached to a second surface of the panel. The second surface of the panel may be opposite the first surface of the panel.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

In accordance with embodiments of the present invention, methods and apparatus are disclosed for an expandable package filler and ornament. The expandable filler and ornament occupies very little volume in its initial configuration, yet it can be easily expanded into its final, configuration, which occupies significantly more volume. The expandable filler and ornament can be used as cushioning filler, i.e., a stuffing material, for a box, bag, basket or other container. Alternatively, the expandable filler and ornament can be used as a decoration, such as in place of a bow, on a box, bag, basket or other container. Alternatively, the expandable filler and ornament can be used as a stand-alone decoration, such as a hanging decoration. For simplicity of explanation, embodiments of the expandable filler and ornament are referred to herein as simply expandable filler.

Figure 1:
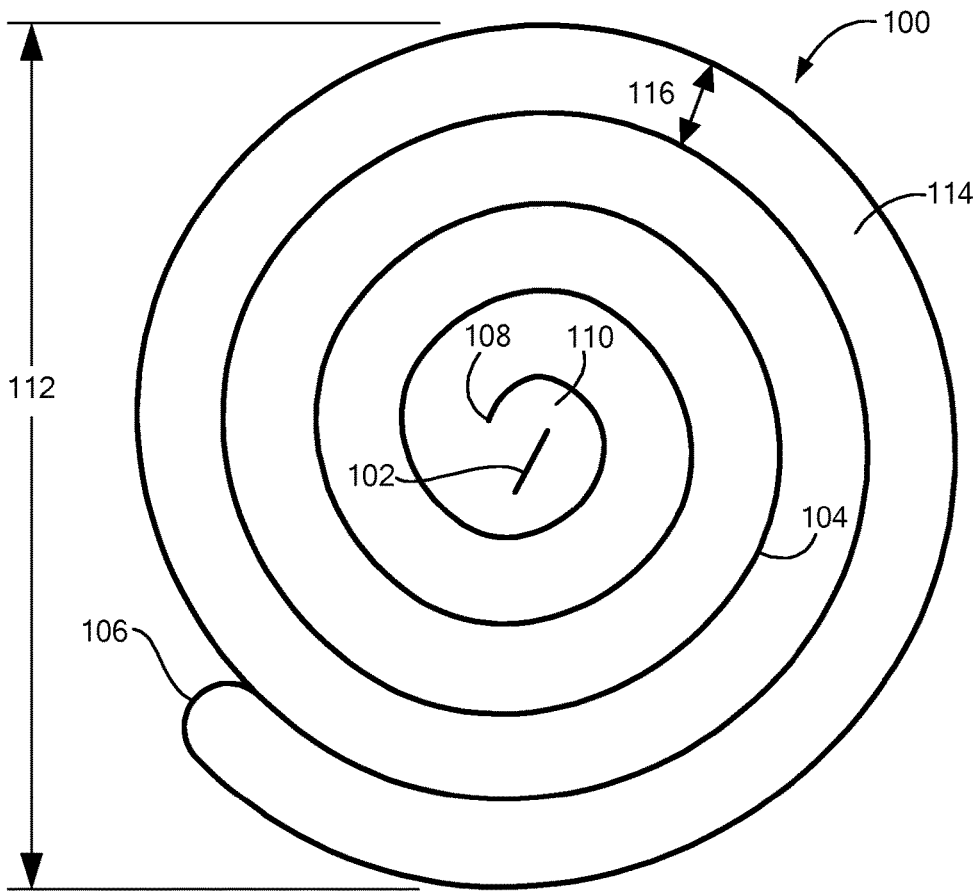
FIG. 1 is a top (plan) view.
Figure 2:
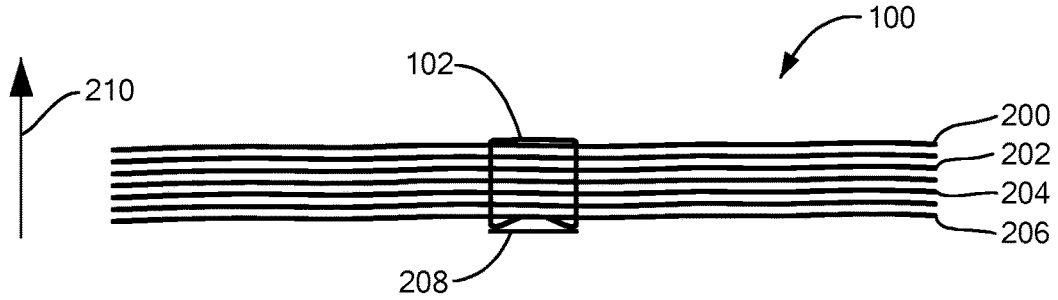
FIG. 2 is a side (elevation) view, of an expandable filler in its initial (non-expanded) configuration, according to an embodiment of the present invention.

FIG. 1 is a top (plan) view, and FIG. 2 is a side (elevation) view, of an expandable filler 100 in its initial (non-expanded) configuration, according to an embodiment of the present invention. As can be seen in FIG. 2, the expandable filler 100 includes a plurality of parallel sheets of tissue paper, crêpe paper, foil, polyester, polypropylene, other plastic or other thin material stacked together, exemplified by sheets 200, 202, 204 and 206, along an axis 210 substantially perpendicular to the planes of the sheets 200-206. For clarity, the sheets 200-206 are shown with spaces between adjacent sheets. However, the sheets 200-206 may be stacked substantially without any space between adjacent sheets. In the embodiment shown in FIGS. 1 and 2, about 45 to about 60 sheets are stacked. However, in other embodiments, other numbers (at least two) of sheets may be stacked together.

In the embodiment shown in FIGS. 1 and 2, all the sheets 200-206 are identically sized (outer dimension 112, in plan view) and shaped (generally circular, in plan view). The outer shapes of the sheets 200-206 register along the axis 210. In other embodiments, all the sheets 200-206 need not be identically sized and/or shaped, as long as at least a portion of each of the sheets 200-206 is present in a peninsula portion 110 (described below).

In some embodiments, all the sheets 200-206 are of equal thickness; however, in other embodiments, the sheets 200-206 of a given stack may be of mixed thicknesses. As used herein, "thin" means less than about 2 mil thick (about 44 grams per square meter (GSM)). Tissue paper has a thickness in a range of about 10-40 GSM. Other suitable materials may be thinner than about 10 GSM. As used herein, "about" means plus or minus 10%.

The sheets 200-206 may all be of the same material, or the sheets 200-206 may be of a mixture of materials. For example, some of the sheets 200-206 may be paper and other of the sheets 200-206 may be foil. Similarly, all of the sheets 200-206 need not be the same color. The sheets 200-206 may all be of the same thickness, or some of the sheets 200-206 may be thicker than others. In particular, the top sheet 200 and the bottom sheet 206 may be thicker and/or stiffer and/or of a different material than the intermediate sheets 202-204.

In the embodiment illustrated in FIGS. 1 and 2, the sheets 200-206 are fastened together approximately at their respective centers via a fastener 102, such as a staple, grommet, adhesive, die punch or other fastener that that binds the approximate centers of the sheets 200-206, without binding other portions of the sheets 200-206 together. An adhesive may be used in the central portion of the sheets 200-206 to bind the sheets together. In other embodiments, the fastener 102 may be located elsewhere, as described herein. In yet other embodiments, no fastener binds the sheets 200-206 together.

The sheets 200-206 are cut along a generally spiral path 104. All the sheets 200-206 may be cut such that the cuts on the sheets 200-206 register along the axis 210. For example, the sheets 200-206 may be stacked, and then the stack may be cut by a die. The cut path 104 extends from the peripheral edge 106 of each sheet 200-206 to a central portion of the sheet, such as to a location 108 radially inward of the peripheral edge 106 of the sheet. However, the cut path 104 stops at the point 108, without intersecting with itself, thereby defining a peninsula 110. All or part of the fastener 102 may, but need not, lie within the peninsula 110. The cut path 104 defines one continuous strip 114 extending from the peripheral edge 106 to the peninsula 110. The strip 114 makes several turns.

Although a single cut through all the sheets 200-206 is anticipated, the cut may be at an angle, other than zero degrees, from the axis 210, and still be considered substantially perpendicular to the planes of the sheets 200-206, as long as the cut is effectively made through all the sheets 200-206 in a single pass while the sheets 200-206 are in intimate contact. That is, each sheet 200-206 should be cut such that, effectively, as a knife or cutting edge of a die exits one of the sheets 200-206 it enters the adjacent sheet 200-206, which is in intimate contact with the sheet from which the knife or die exited. In actual manufacture, the sheets 200-206 need not, however, be cut literally in a single pass of a knife or die.

Figure 3:
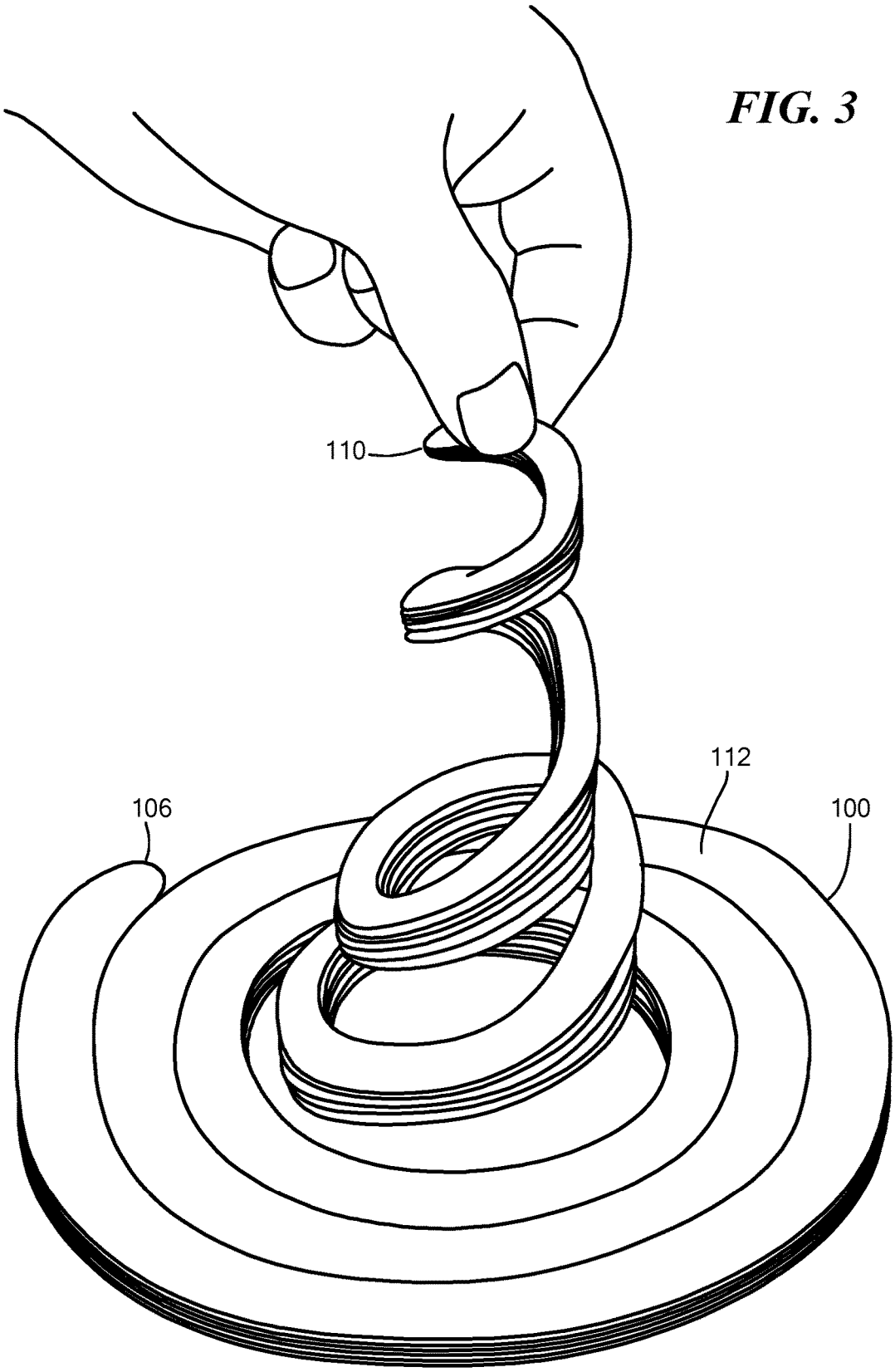
FIG. 3 is a perspective view of the expandable filler of FIGS. 1 and 2, illustrating expansion of the filler from its initial configuration to an intermediate stage of expansion, according to an embodiment of the present invention.

FIG. 3 is a perspective view of the expandable filler 100 illustrating how the filler 100 is expanded from its initial configuration. In FIG. 3, the filler 100 is in the process of being expanded, but it has not yet been fully expanded to it final configuration. The filler 100 may be grasped by the peninsula 110, and the peninsula 110 may be elevated, relative to the remainder of the filler 100. As the peninsula 110 is elevated, the turns of the strips 114 lift up progressively, from the center toward the peripheral edge 106. Alternatively, the expandable filler 100 may be suspended by the peninsula 110, and the turns of the strips 114 may be allowed to fall under the influence of gravity. In either case, some of the strips 114 entangle with each other. Optionally, the expandable filler 100 may be shaken to further entangle the strips 114. If no fastener 102 binds the sheets 200-206 together, a user or tool should grasp the peninsula 110 sufficiently firmly to prevent the sheets 200-206 separating, while the expandable filler 100 is expanded or shaken.

Figure 4:
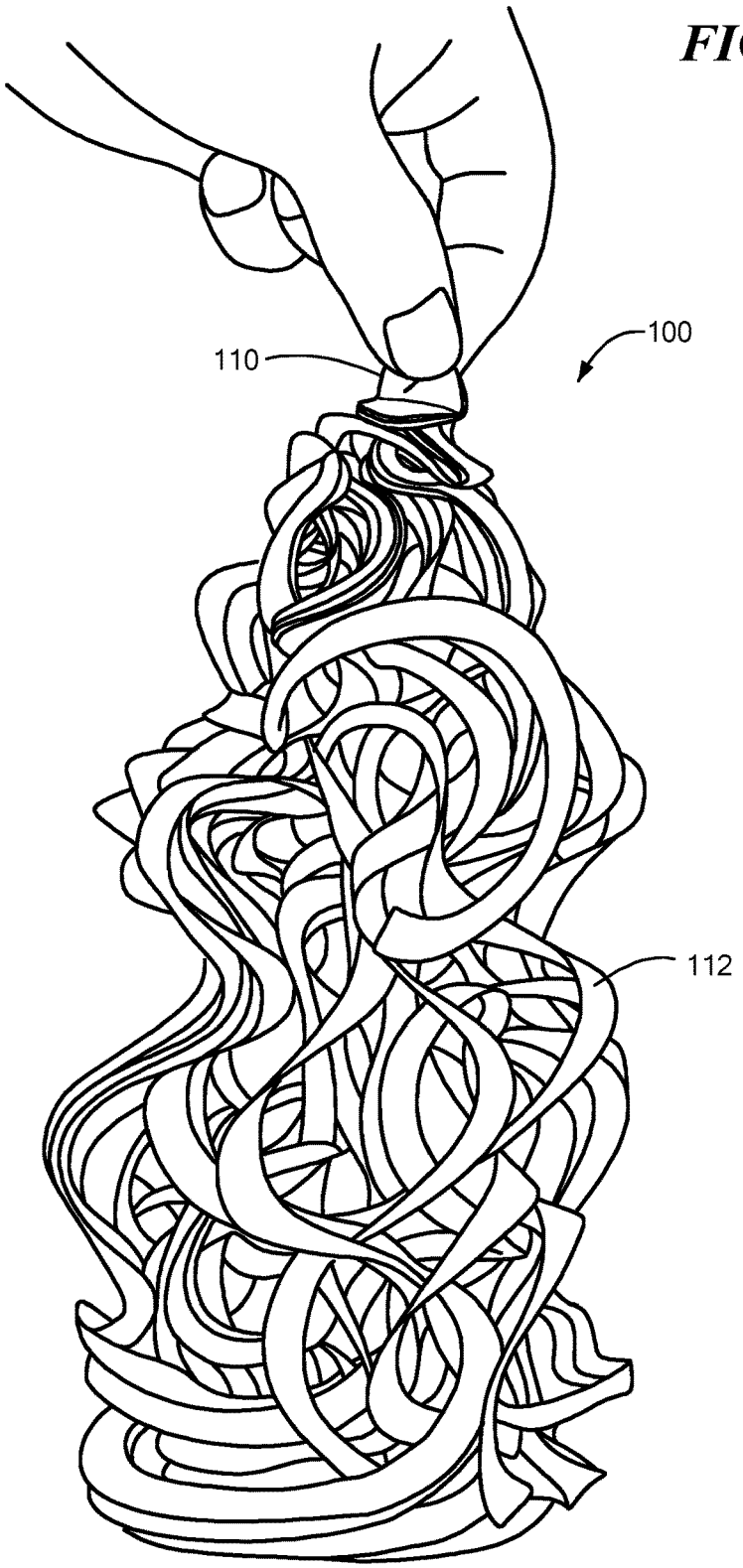
FIG. 4 is a perspective view of the expandable filler of FIGS. 1-3 in a more fully expanded configuration, according to an embodiment of the present invention.
Figure 5:
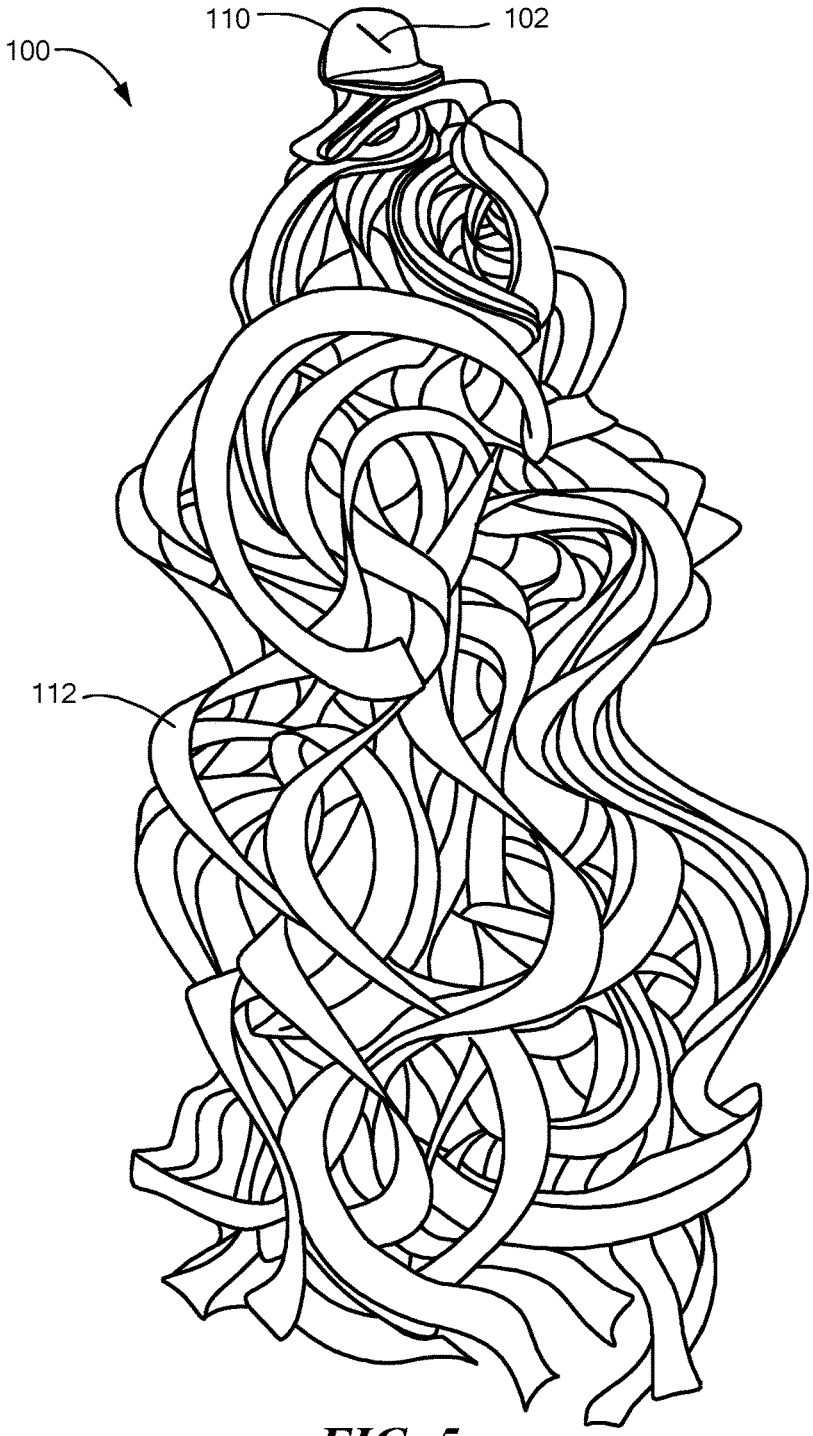
FIG. 5 is a side (elevation) view of the expandable filler of FIGS. 1-4 in its fully expanded configuration, according to an embodiment of the present invention.

FIG. 4 is a perspective view of the expandable filler 100 in a more fully expanded configuration. FIG. 5 is a side (elevation) view of the expandable filler 100 after it has been shaken to further entangle the strips 114.

Figure 6:
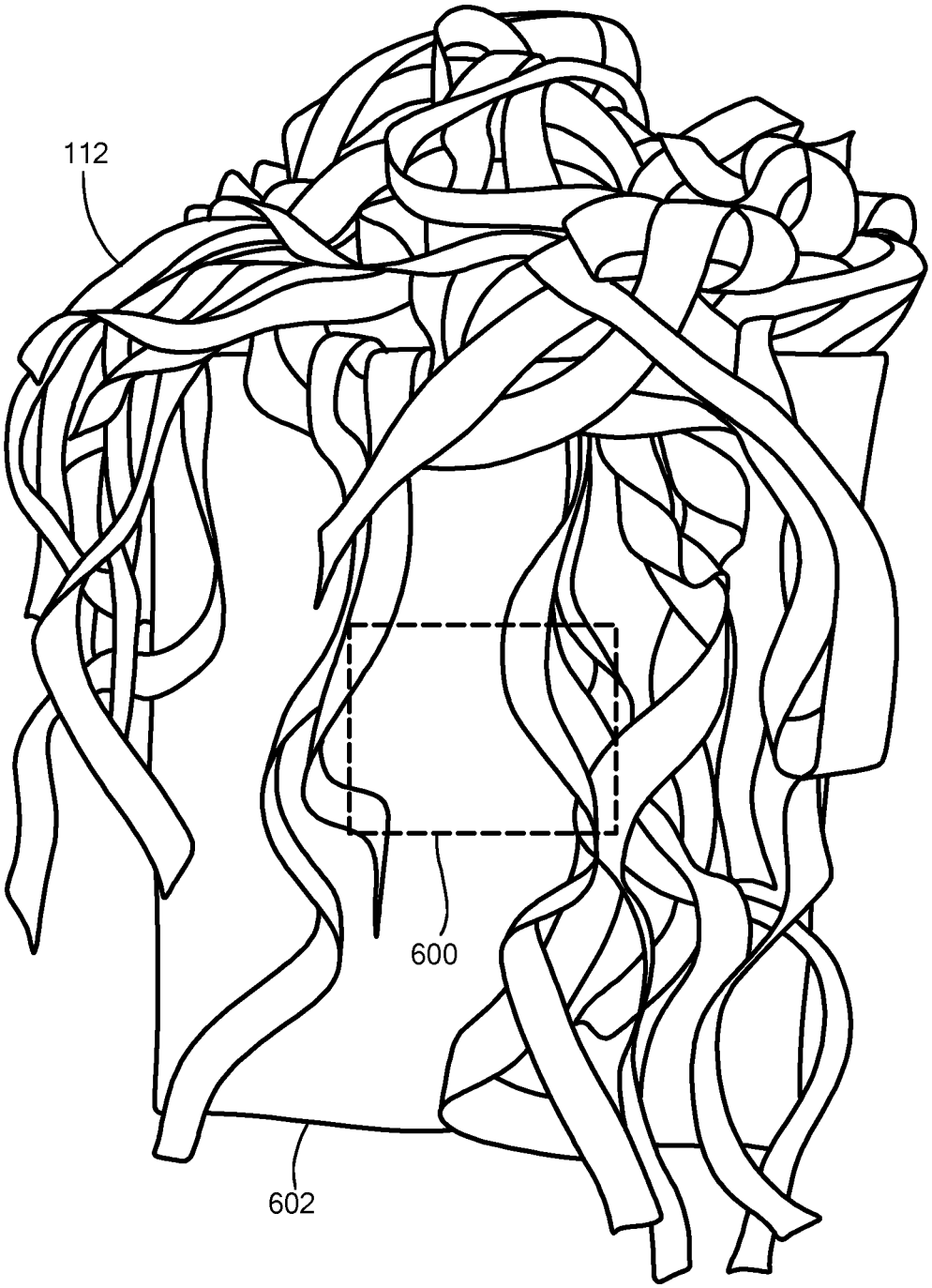
FIG. 6 is a perspective view of the expandable filler of FIGS. 1-5 in an exemplary use, according to an embodiment of the present invention.

The entangled strips 114 form a suitable packing material to cushion fragile items in a container, as exemplified in FIG. 6. In this example, a gift 600 (shown schematically in phantom) is disposed within a gift bag 602, and all or a portion of the strips 114 are stuffed into the bag 602.

For stuffing typically-sized gift bags, the stack of parallel sheets, in its initial configuration, may be about 6½ inches (16.5 cm) in diameter, as indicated at 112 (FIG. 1), and the width 116 of the strips 114 may be about ⅜ inch (9.5 mm). Of course, smaller or larger configurations are possible.

For example, an expandable filler 100 having an initial configuration diameter 112 of about 3½ inches (8.9 cm) may be used as a bow for a gift box, bag or other container. In one embodiment, such an expandable filler 100 includes a strip of double-stick adhesive tape 208 (FIG. 2) and optional release sheet attached to the fastener 102 or to either the top sheet 200 or the bottom sheet 206 of the peninsula 110 to facilitate attaching the bow to the gift container.

Figure 7:
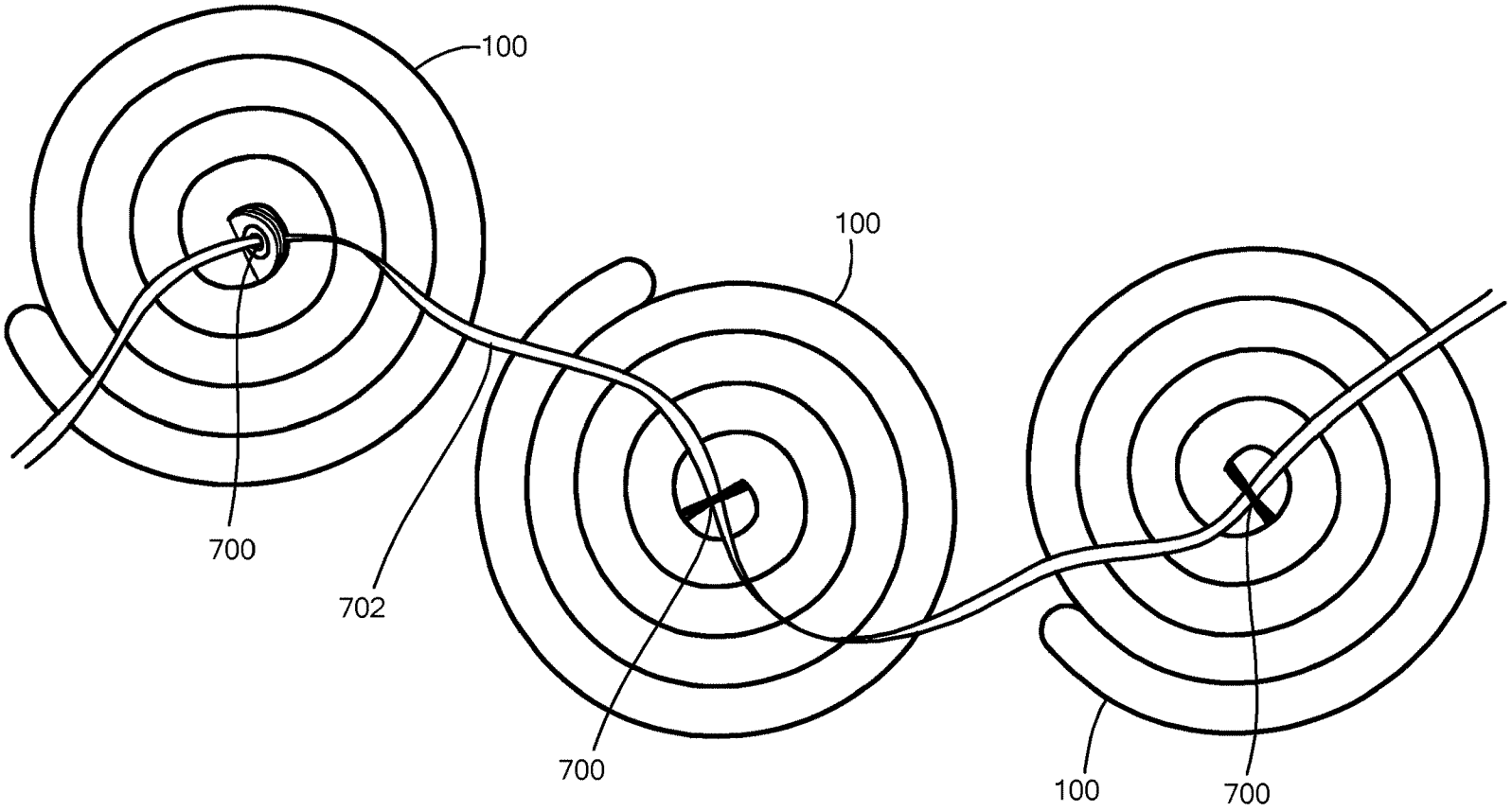
FIG. 7 is a top (plan) view.
Figure 8:
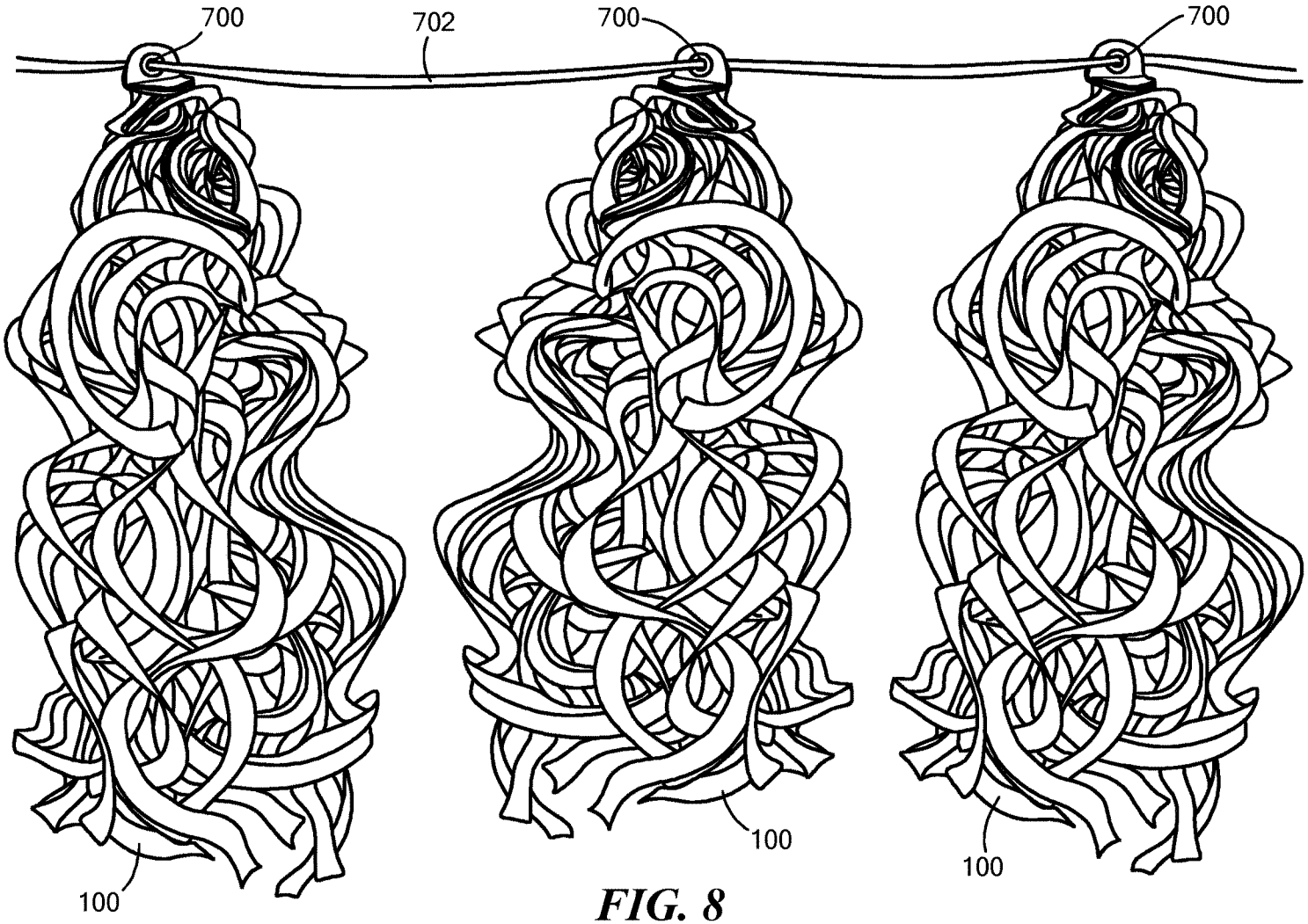
FIG. 8 is a side (elevation) view, perspective view of a plurality (three, in this example) of the expandable fillers of FIGS. 1-5 in another exemplary use, according to an embodiment of the present invention.

These or other sizes (diameters 112) may be used for expandable fillers 100 used as stand-alone decorations. As shown in FIGS. 7 and 8 (top and side views, respectively), in some embodiments, a grommet 700 is used as the fastener 102, thereby defining a hole. A string, ribbon or other type of cord 702 passing through the grommet(s) 700 may then suspend one or more expandable fillers 100.

Figure 9:
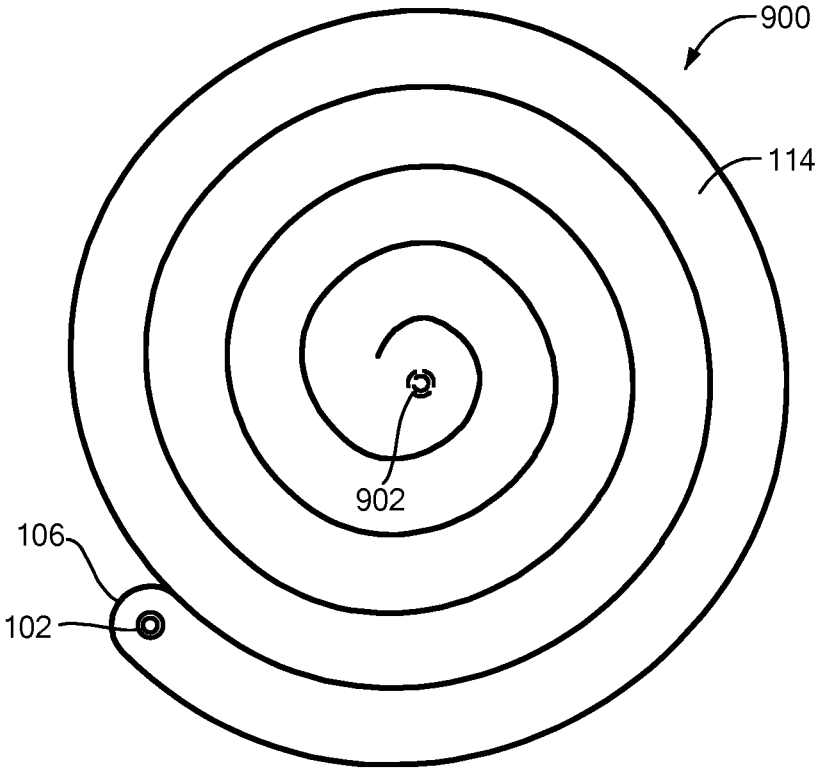
FIGS. 9, 10, 11, 12, 13, 14, 15 and 16 are top (plan) views.

Although the sheets 200-206 have been described as being fastened together approximately at their centers, in other embodiments the sheets 200-206 may be fastened at other locations. For example, as illustrated in FIG. 9, the sheets 200-206 may be fastened at the peripheral end 106 of the strips 114. Optionally, multiple fasteners may be used to fasten one or both ends of the strips 114, as indicated in broken line at 902. In some embodiments, multiple grommets are used as fasteners, permitting cord to be strung through the grommets.

Figure 10:
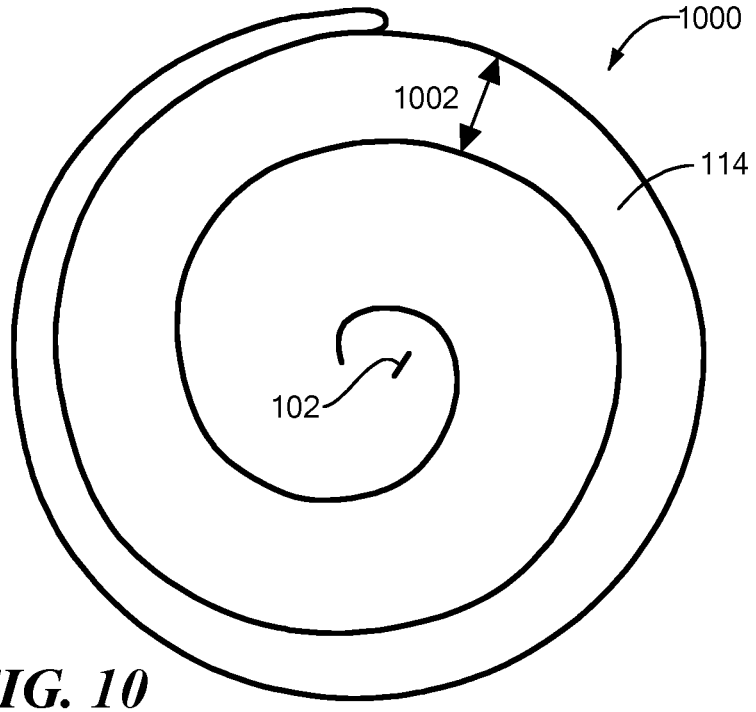
Figure 11:
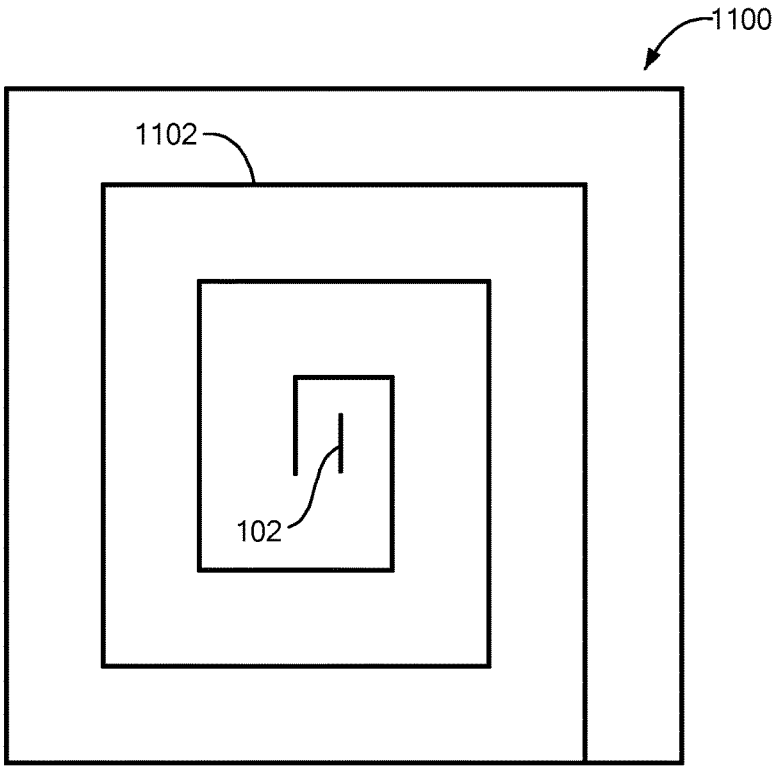

Although generally circular (in plan view) sheets 200-206 and a generally circular spiral cut path 104 has been described, other shapes (in plan view) of sheets and/or other shapes for the cut may be used. Although each sheet 200-206 is shown cut such that the strips 114 are relatively uniform in width 116 (FIG. 1), along their lengths, the sheets 200-206 may be cut such that the widths 116 of the strips 114 vary along their lengths. FIG. 10 is a plan view of an expandable filler 1000 in which the width 1002 of the strips 114 tapers along the lengths of the strips 114. In some embodiments (not shown), the sheets 200-206 are cut along wavy lines, such that the width 116 of the strips 114 undulates along the lengths of the strips. The cut lines may be smooth or angled, as though cut by pinking shears. FIG. 11 is a plan view of an expandable filler 1100 in which the cut 1102 generally follows a square spiral path. In some embodiments (not shown) the cut follows another path, such as a generally irregular spiral path.

Figure 12:
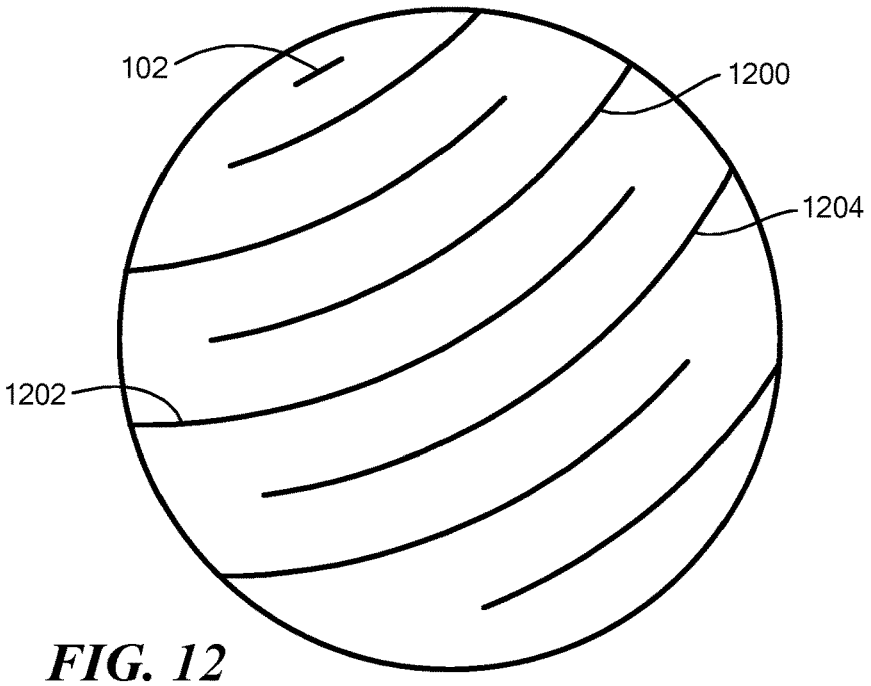

In some other embodiments, exemplified in FIG. 12, the sheets 200-206 are cut along a plurality of disconnected paths, such as cut paths 1200, 1202 and 1204.

Although cuts along straight lines and smoothly curved lines have been described, the cuts may follow any desired path. For example, in some embodiments, the cuts follow a zig zag (pinking) pattern.

Figure 13:
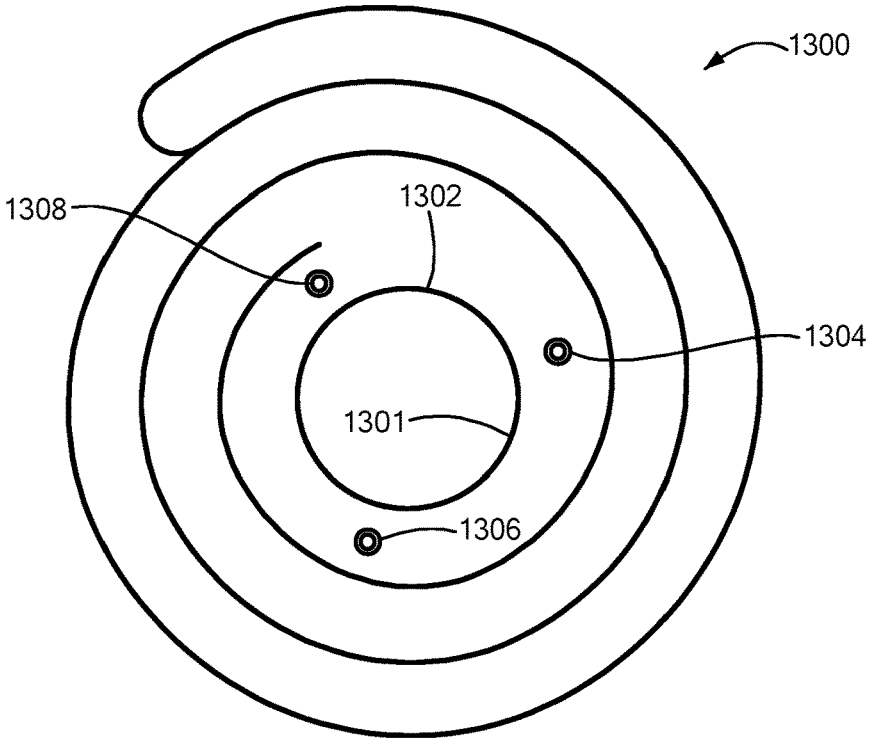

FIG. 13 is a plan view of yet another embodiment of an expandable filler 1300. In this embodiment, the sheets 200-206 are spiral cut, as in the embodiment discussed with respect to FIGS. 1 and 2, although the sheets 200-206 can be cut in other ways. Peninsula portions 1301 of the sheets 200-206 of the expandable filler 1300 define a circular or other shaped hole 1302 in each sheet. The holes 1302 may be die cut. The holes 1302 register along an axis analogous to the axis 210 (FIG. 2). The holes 1302 may be sized large enough to fit over, for example, a neck of a bottle, such as a wine bottle, but not large enough to fit around the body of the bottle. In some embodiments, the holes 1302 are about 1¼ inches (3.175 cm) in diameter. Thus, the expandable filler 1300 may be draped over the bottle as a decoration and/or as stuffing, for example, if the bottle is disposed in a gift bag or box. A suitable number of fasteners 1304, 1306 and 1308 secure the sheets 200-206 to each other. Although three fasteners 1304-1308 are shown, other numbers of fasteners may be used.

Figure 14:
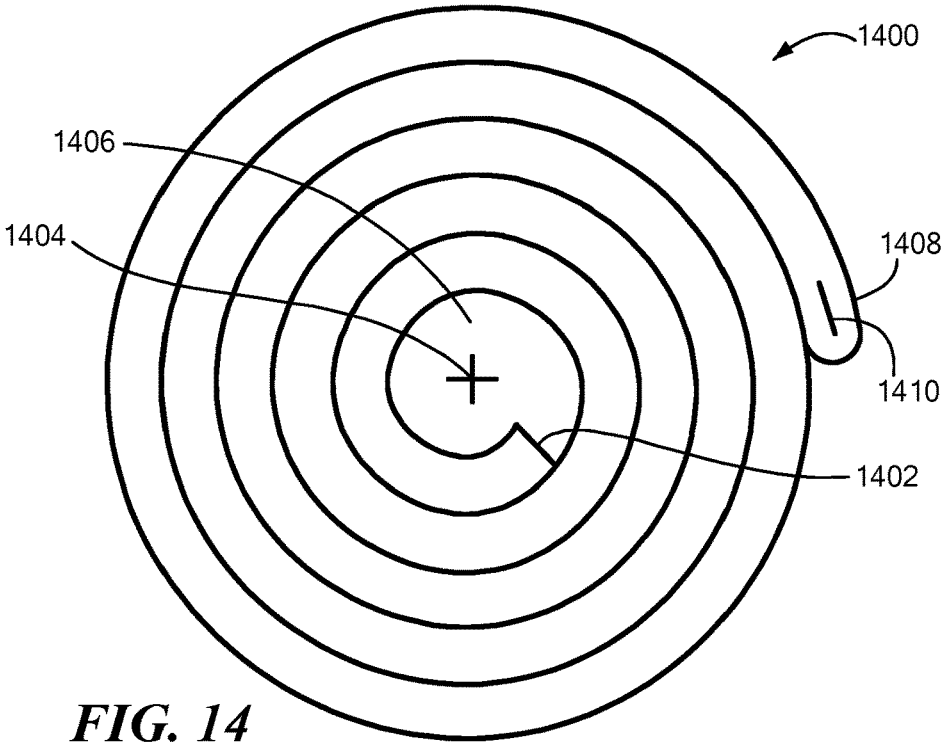

FIG. 14 is a plain view of another embodiment of an expandable filler 1400. In this embodiment, the sheets 200-206 are spiral cut, as in the embodiments discussed with respect to FIGS. 1 and 2, although the sheets 200-206 may be cut in other ways. Peninsula portions 1402 of the sheets 200-206 do not, however, reach the center 1404 of the sheets 200-206. The peninsula portions 1402 surround a hole 1406. The sheets 200-206 are fastened together at a circumferential end 1408 of the spiral cut by a staple, grommet or other suitable fastener 1410. The embodiment of FIG. 14 may be expanded by grasping the circumferential end 1408 and lifting it, and then optionally shaking the expandable filler 1400.

Figure 15:
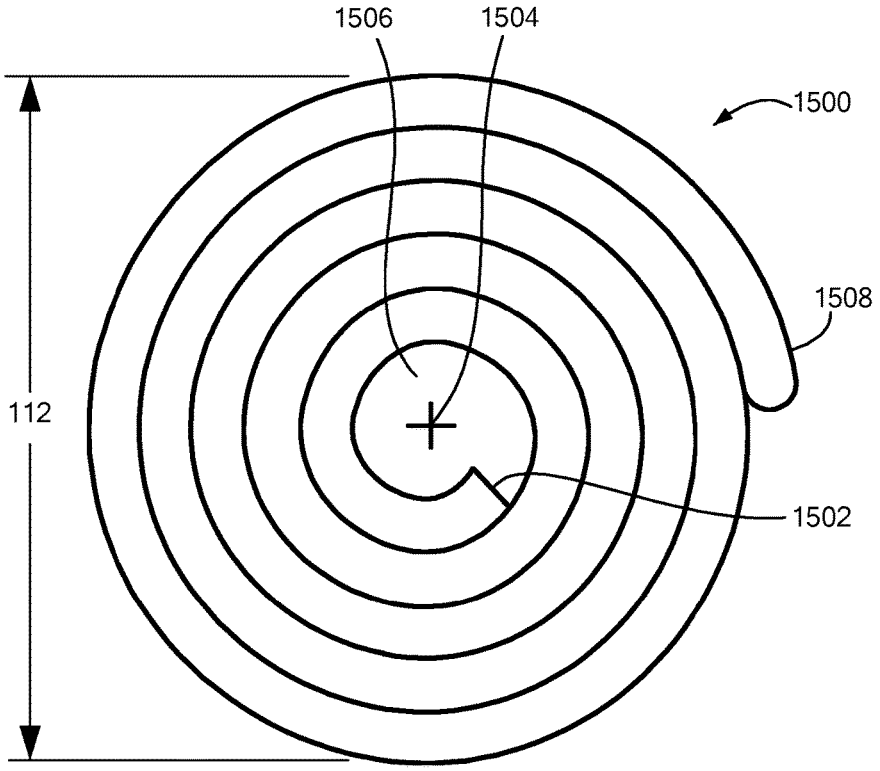

FIG. 15 is a plan view of yet another embodiment of an expandable filler 1500. In this embodiment, the sheet 200-206 are spiral cut, as in the embodiments discussed with respect to FIGS. 1 and 2, although the sheets 200-206 may be cut in other ways. However, the expandable filler 1500 does not include a fastener. To expand the filler 1500, a user grasps one end 1502 or the other end 1508, lifts the end 1506 or 1508 and shakes the expandable filler 1500, as discussed with respect to FIGS. 3-5. The expandable filler 1500 thus provides a more compact way of shipping shred than in the prior art. Omitting the fastener reduces cost of producing the expandable filler 1500 and, depending on material of the fastener, may make recycling the expandable filler 1500 easier.

Figure 16:
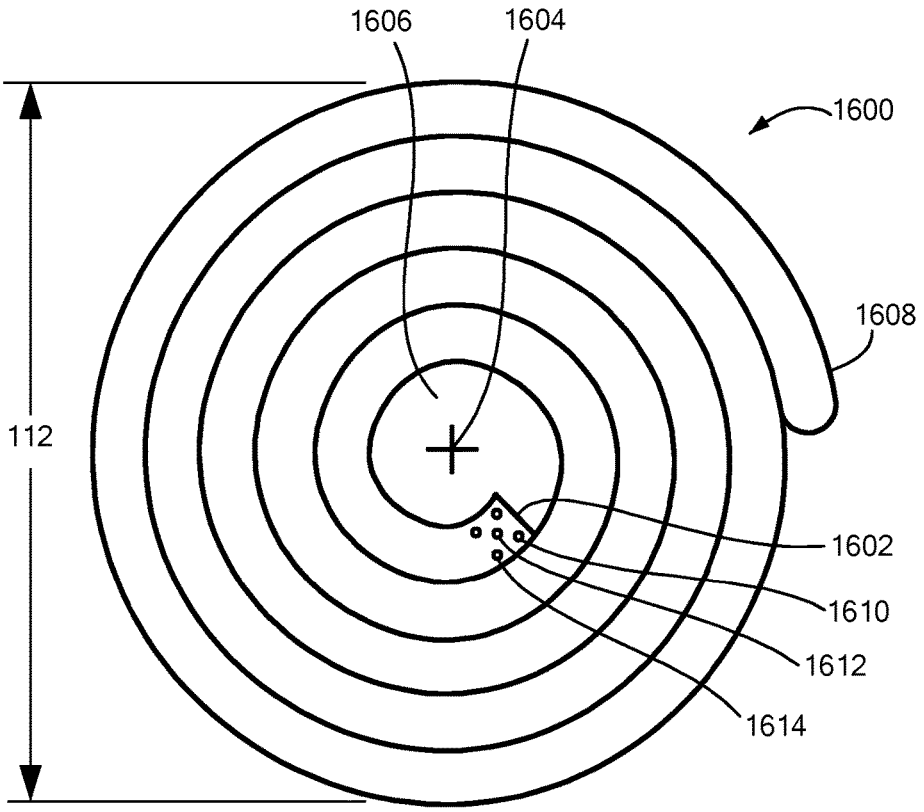
Figure 17:
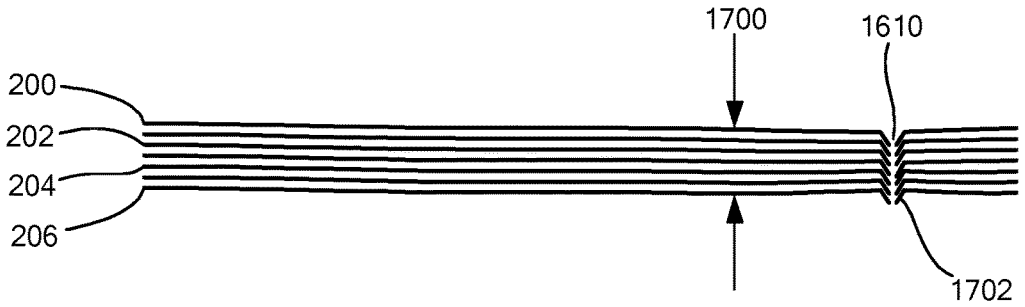
FIG. 17 is a side view, of expandable fillers in their initial (non-expanded) configurations, according to respective other embodiments of the present invention.

FIG. 16 is a plan view, and FIG. 17 is a side view, of another embodiment of an expandable filler 1600. In this embodiment, the sheet 200-206 are spiral cut, as in the embodiments discussed with respect to FIGS. 1 and 2, although the sheets 200-206 may be cut in other ways. As part of die cutting the spiral shape, or in a separate operation, one or more holes, exemplified by holes 1610, 1612 and 1614, are punched through the sheets 200-206. The holes 1610-1614 may be punched with spiked dies, such as sharp pins, rather than dies having circular or annular cross-sectional shapes. In FIG. 17, the holes 1610-1614 are shown at the inside end 1602 of the spiral. However, in other embodiments, the holes 1610-1614 may be at the peripheral end 1608 of the spiral or elsewhere along the spiral.

As can be seen in FIG. 17, when the die punches a hole, the die deforms each sheet 200-206 in an area surrounding the hole 1610. In particular, the die forms conical depressions in each sheet 200-206, and die may form splays, exemplified by splay 1702. The pressure of the die also compresses the sheets 200-206 in their thickness direction 1700. This pressure, compression, deformation and/or spays fuse and/or bind adjacent sheets 200-206 to each other. Although the sheets 200-206 may not be fused or bound together as tightly as a staple or a grommet might bind the sheets 200-206 (as in other embodiments), the sheets 200-206 are fused and/or bound together sufficiently to hold them together during insertion into envelopes, shipment, storage, display on a store shelf and while a user expands the filler 1600. Thus, in this embodiment, punched holes and/or splays act as fasteners to binding together the stack of sheets 200-206 along the axis 210, and the term "fastener," as used herein, includes holes and/or splays.

Foregoing separate fasteners reduces cost of producing the expandable filler 1600 and makes recycling the expandable filler 1600 easier. Punched hole fasteners also facilitate a user removing a selected number of the sheets 200-206 of the stack, without tools or risk of injury, such as from a staple.

Although five holes 1610-1614 are shown, other number of holes may be punched depending, for example, on the number of sheets 200-206 in the stack, the thickness of the sheets 200-206, the type of material from which the sheets 200-206 are made, width of the spiral-cut strips, length of the strips, diameter 112 of the sheets, etc. As with other embodiments, the binding holes 1610-1614 may be made at either end 1602 or 1608 of the spiral strips, or elsewhere along the lengths of the strips. The filler 1600 may be expanded as described with respect to other embodiments.

Although small-diameter holes 1610-1614 may bind the sheets 200-206 better than larger diameter holes, larger diameter holes may provide sufficient binding force to enable a user to grasp an end of the spiral strip, without the sheets 200-206 translating laterally, with respect to each other. Furthermore, larger-diameter holes 1610-1614 may accept strings, ribbons, etc., as described herein, thereby eliminating a need for a grommet.

Embodiment described herein may be modified to provide crinkled strips of shred. Such embodiments may be made by pressing a stack of sheets 200-206 between male and complementary female die that are shaped to impart a crinkle pattern to the sheets 200-206, such as with ridges of the crinkles extending radially from the center of the stack of sheets 200-206.

One or more of the sheets 200-206 of any embodiment may be printed with suitable words and/or symbols, such as "Happy Birthday" or "♪♪" (musical notes).

Crêpe paper is tissue paper that has been coated with sizing (a glue-like substance) and then creped (creased in a way similar to party streamers) to create gathers.

Figure 19:
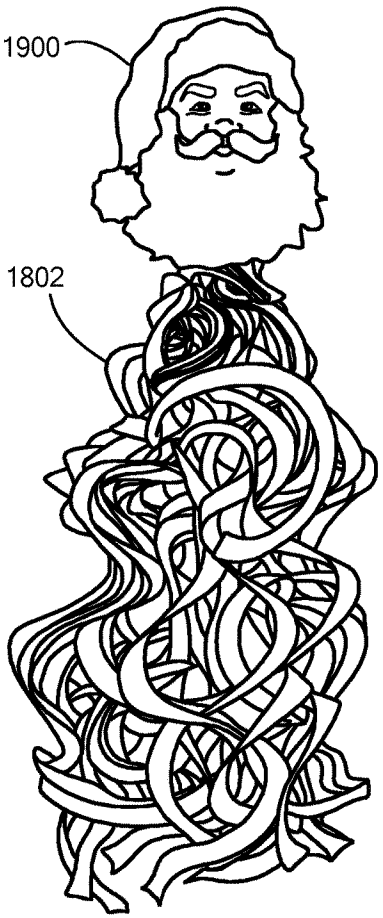
FIGS. 18 and 19 are front views of respective expandable fillers of FIGS. 1-16, with a panel attached to each, according to another embodiment of the present invention.
Figure 18:
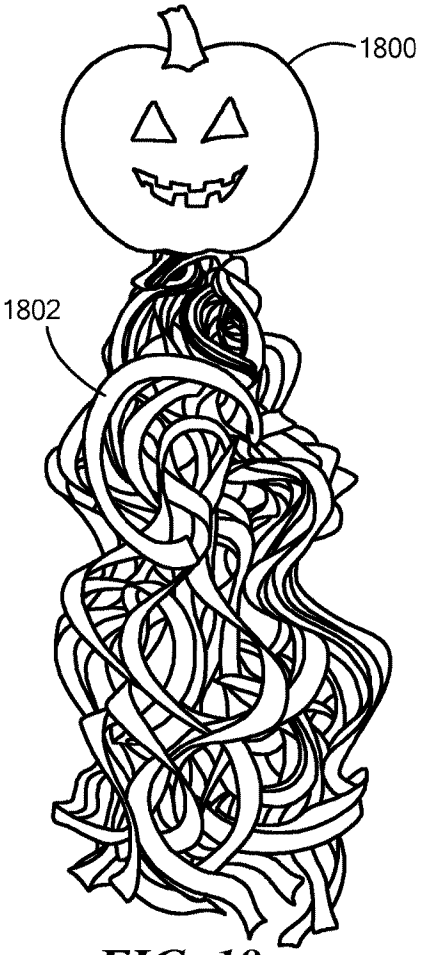

Optionally, as shown in FIGS. 18 and 19, a panel, exemplified by panels 1800 and 1900, may be attached to one end of any of the expandable fillers 1802 (shown expanded) described herein. The panel 1800 or 1900 may be made of cardboard, plastic, metal or another suitable material. The panel 1800 or 1900 may have a holiday or other occasion-themed image or other indicia (collectively herein referred to as an "image") printed, painted, engraved or otherwise affixed to a front, and optionally a back, surface thereof. For example, an image of a jack-o-lantern is shown on the panel 1800, and an image of a Santa Claus face is shown on the panel 1900. Other exemplary panels may include images of a witch, birthday cake or Easter bunny, etc. The sheets 200-206 (FIG. 2) may be colored according to the image, indicia or theme. For example, for a Christmas-themed embodiment, some of the sheets 200-206 may be colored red, and other of the sheets 200-206 may be colored green.

Figure 20:
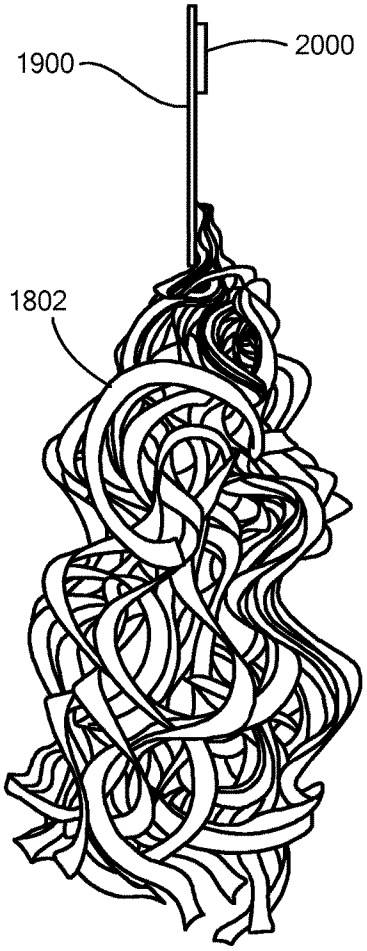
FIG. 20 is a side view of the expandable filler of FIG. 19.

FIG. 20 is a side view of the embodiment of FIG. 19. A hook, pin, magnet, loop, pile, adhesive patch or other mounting 2000 may be attached to the back side of the panel 2002 to facilitate mounting or attaching the panel 1900 to a wall, door, string or the like.

While specific parameter values may be recited for disclosed embodiments, within the scope of the invention, the values of all of parameters may vary over wide ranges to suit different applications. While the invention is described through the above-described exemplary embodiments, modifications to, and variations of, the illustrated embodiments may be made without departing from the inventive concepts disclosed herein. Furthermore, disclosed aspects, or portions thereof, may be combined in ways not listed above and/or not explicitly claimed. Accordingly, the invention should not be viewed as being limited to the disclosed embodiments.

What is claimed is:

1. An expandable filler, comprising: a stack of about 30 to about 60 parallel sheets, each sheet comprising a flexible material having a respective thickness less than about 2 mil and defining at least one cut through the thickness of the sheet, the at least one cut extending from a peripheral edge of the sheet to a location radially inward of the peripheral edge of the sheet, the at least one cut defining a peninsula portion of the sheet proximate the location radially inward of the peripheral edge of the sheet and a generally spiral shaped strip extending continuously from the peninsula portion to a peripheral end portion located along the peripheral edge of the sheet, wherein the generally spiral shaped strips of the respective sheets are coextensive with each other and, in an initial configuration, collectively occupy a first volume, the generally spiral shaped strips being configured to entangle with at least some of each other in response to shaking to form, in an expanded configuration, a cushioning packing material having a volume greater than the first volume, and wherein the generally spiral shaped strips are fastened together in intimate contact at only the peripheral end portion of each of the generally spiral shaped strips.

2. An expandable filler as defined in claim 1, further comprising a fastener binding together the stack of sheets along an axis.

3. An expandable filler as defined in claim 2, wherein the fastener comprises at least one of: a staple, a grommet, an adhesive and a punched hole extending through the stack of parallel sheets, thereby fusing adjacent sheets to each other.

4. An expandable filler as defined in claim 1, wherein the at least one cut follows at least one of: a generally circular spiral path, a generally square spiral path and a generally irregular spiral path.

5. An expandable filler as defined in claim 1, wherein each peninsula portion defines a generally circular hole through the stack of sheets.

6. An expandable filler as defined in claim 1, wherein each sheet of the stack of sheets comprises at least one of: a sheet of paper, a sheet of crpe paper and a sheet of plastic.

7. An expandable filler as defined in claim 1, wherein at least one sheet of the stack of sheets comprises a sheet of foil, and each sheet of a remainder of the stack of sheets comprises a sheet of paper.

8. An expandable filler as defined in claim 1, wherein at least one sheet of the stack of sheets comprises a sheet of plastic, and each sheet of a remainder of the stack of sheets comprises a sheet of paper.

9. An expandable filler as defined in claim 1, wherein each sheet of the stack of sheets comprises a sheet having a thickness less than about 1 mil.

10. An expandable filler as defined in claim 1, further comprising: a panel having an image affixed on at least a first surface thereof, the panel being attached to the stack of sheets.

11. An expandable filler as defined in claim 10, further comprising a mounting attached to a second surface, opposite the first surface, of the panel.

12. An expandable filler, comprising: a stack of about 30 to about 60 parallel sheets, each sheet comprising a flexible material having a respective thickness less than about 2 mil and defining at least one cut through the thickness of the sheet, the at least one cut extending from a peripheral edge of the sheet to a location radially inward of the peripheral edge of the sheet, the at least one cut defining a peninsula portion of the sheet proximate the location radially inward of the peripheral edge of the sheet and a generally spiral shaped strip extending continuously from the peninsula portion to a peripheral end portion located along the peripheral edge of the sheet, wherein the generally spiral shaped strips of the respective sheets are coextensive with each other and, in an initial configuration, collectively occupy a first volume, the generally spiral shaped strips being configured to entangle with at least some of each other in response to shaking to form, in an expanded configuration, a cushioning packing material having a volume greater than the first volume, and wherein the generally spiral shaped strips are fastened together in intimate contact at only the peninsula portion of each of the generally spiral shaped strips.

13. An expandable filler as defined in claim 12, further comprising a fastener binding together the stack of sheets along an axis.

14. An expandable filler as defined in claim 13, wherein the fastener comprises at least one of: a staple, a grommet, an adhesive and a punched hole extending through the stack of parallel sheets, thereby fusing adjacent sheets to each other.

15. An expandable filler as defined in claim 12, wherein the at least one cut follows at least one of: a generally circular spiral path, a generally square spiral path and a generally irregular spiral path.

16. An expandable filler as defined in claim 12, wherein each peninsula portion defines a generally circular hole through the stack of sheets.

17. An expandable filler as defined in claim 12, wherein each sheet of the stack of sheets comprises at least one of: a sheet of paper, a sheet of crêpe paper and a sheet of plastic.

18. An expandable filler as defined in claim 12, wherein at least one sheet of the stack of sheets comprises a sheet of foil, and each sheet of a remainder of the stack of sheets comprises a sheet of paper.

19. An expandable filler as defined in claim 12, wherein at least one sheet of the stack of sheets comprises a sheet of plastic, and each sheet of a remainder of the stack of sheets comprises a sheet of paper.

20. An expandable filler as defined in claim 12, wherein each sheet of the stack of sheets comprises a sheet having a thickness less than about 1 mil.

21. An expandable filler as defined in claim 12, further comprising: a panel having an image affixed on at least a first surface thereof, the panel being attached to the stack of sheets.

22. An expandable filler as defined in claim 21, further comprising a mounting attached to a second surface, opposite the first surface, of the panel.

* * * * *